US007874085B1

(12) United States Patent
Winter et al.

(10) Patent No.: US 7,874,085 B1
(45) Date of Patent: Jan. 25, 2011

(54) PLOW BLADE AND MOLDBOARD SHOE

(75) Inventors: Kent Winter, Willoughby, OH (US); Phil Prucey, Willoughby, OH (US)

(73) Assignee: Winter Equipment Company, Willoughby, OH (US)

( * ) Notice: Subject to any disclaimer, the term of this patent is extended or adjusted under 35 U.S.C. 154(b) by 0 days.

(21) Appl. No.: 12/724,460

(22) Filed: Mar. 16, 2010

(51) Int. Cl.
*E01H 5/06* (2006.01)
*E02F 3/08* (2006.01)

(52) U.S. Cl. ..... 37/270; 37/266; 37/271; 37/460; 172/701.3

(58) Field of Classification Search ..... 37/266, 37/270, 271, 232, 233, 446, 460, 465, 903; 172/701.3
See application file for complete search history.

(56) References Cited

U.S. PATENT DOCUMENTS 1,543,222 A * 6/1925 McVeety ..... 172/701.3
1,882,945 A * 10/1932 Ross ..... 37/279
1,887,451 A * 11/1932 Dombrowski ..... 37/270
1,904,201 A * 4/1933 Chapman ..... 37/272
1,922,917 A * 8/1933 Russell et al. ..... 172/701.3
1,927,818 A * 9/1933 Brodersen ..... 299/105
1,957,103 A * 5/1934 Prink ..... 37/232
2,061,585 A 11/1936 Meyer
2,108,541 A * 2/1938 Lull ..... 280/845
2,138,783 A * 11/1938 Clark et al. ..... 37/270
2,202,309 A * 5/1940 Campbell ..... 280/28
2,403,219 A * 7/1946 Hanson et al. ..... 37/270
2,460,348 A * 2/1949 Henry ..... 172/832
2,513,231 A * 6/1950 Bourne ..... 37/271
2,611,979 A * 9/1952 Weller ..... 37/270
2,831,276 A * 4/1958 Foster ..... 172/817
2,994,138 A * 8/1961 Franz ..... 37/267
3,217,431 A * 11/1965 Heinzroth et al. ..... 37/270
3,465,456 A 9/1969 Meyer
3,477,149 A 11/1969 Wagner
3,529,677 A * 9/1970 Stephenson ..... 172/701.3
3,604,517 A * 9/1971 Clifford ..... 172/225
3,888,027 A * 6/1975 Toews ..... 37/460
3,934,654 A * 1/1976 Stephenson et al. ..... 172/701.3
3,997,934 A * 12/1976 Toews ..... 15/246
4,050,170 A 9/1977 Proehl
4,058,173 A * 11/1977 Carson ..... 172/701.3
4,086,966 A * 5/1978 Lanz et al. ..... 172/701.3
4,141,160 A * 2/1979 Olson ..... 37/460
4,250,760 A 2/1981 Garries
4,346,528 A 8/1982 Shwayder
4,441,266 A * 4/1984 Westimayer ..... 37/244
4,450,635 A 5/1984 Shwayder
4,476,642 A 10/1984 Hemphill
4,500,766 A * 2/1985 Reinhardt ..... 219/76.1
4,590,694 A 5/1986 Block (Continued)

*Primary Examiner*—Thomas A Beach
(74) *Attorney, Agent, or Firm*—Fay Sharpe LLP; Karl W. Hauber

(57) ABSTRACT

The present disclosure provides a plow blade edge device for mounting to a moldboard of a plow comprising at least one adapter blade including a bottom edge having a carbide insert along at least a portion of the bottom edge. The device further includes at least one moldboard shoe selectively reversible to present the adapter blade at a first angle or a second angle. The device further includes at least one impact bar mounted to a front side of the adapter blade. The at least one moldboard shoe can include a bottom edge having a carbide insert along at least a portion of the bottom edge.

27 Claims, 6 Drawing Sheets

U.S. PATENT DOCUMENTS 4,607,781 A 8/1986 Shwayder
4,711,503 A 12/1987 Berchem
4,715,450 A * 12/1987 Hallissy et al. ..... 172/701.3
4,756,102 A 7/1988 Chapman
4,770,253 A * 9/1988 Hallissy et al. ..... 172/701.3
4,833,801 A 5/1989 Winter
4,899,472 A 2/1990 Winter
5,081,774 A 1/1992 Kuwano
5,096,772 A 3/1992 Snyder
5,210,965 A 5/1993 Funk
5,375,350 A 12/1994 Maybon
5,427,186 A * 6/1995 Adrian et al. ..... 172/701.3
5,471,770 A 12/1995 Ferreira
5,611,157 A 3/1997 Ferreira
5,636,458 A 6/1997 Drake
5,647,448 A 7/1997 Skaggs
5,724,755 A 3/1998 Weagley
5,743,033 A 4/1998 Gegel
5,809,760 A * 9/1998 Rexroat ..... 56/400.05
5,813,474 A * 9/1998 Manway ..... 172/701.3
5,822,893 A 10/1998 Ostermeyer
5,881,480 A * 3/1999 Fall ..... 37/460
5,946,830 A 9/1999 Ostermeyer
6,000,117 A * 12/1999 Bain ..... 29/458
6,240,662 B1 6/2001 Borowiak
6,256,910 B1 7/2001 Grozde
6,258,193 B1 7/2001 Coffin
6,269,559 B1 8/2001 Edwards
6,315,056 B1 11/2001 Ransom et al.
6,457,269 B1 10/2002 Esterhuyse
6,560,904 B2 5/2003 Guggino
6,571,493 B2 6/2003 Amano et al.
6,832,443 B1 12/2004 Piel et al.
6,854,527 B2 * 2/2005 Baldwin et al. ..... 172/719
6,854,808 B2 2/2005 Kostecki
6,922,924 B2 8/2005 Jones et al.
7,143,531 B2 12/2006 Micozzi
7,159,344 B2 1/2007 Karhi
7,347,014 B1 3/2008 Fiandach
2003/0182824 A1 10/2003 Coffin et al.
2003/0221338 A1 12/2003 Verseef
2004/0006898 A1 1/2004 Koch et al.
2006/0218822 A1 10/2006 Hosmer
2007/0062072 A1 3/2007 Schmeichel
2007/0256334 A1 11/2007 Schmeichel
2008/0263907 A1 10/2008 Winter

* cited by examiner

PLOW BLADE AND MOLDBOARD SHOE

BACKGROUND

The present disclosure relates generally to devices for improving the durability, performance, and operation of plow blades. Specifically, the present disclosure provides an improved plow blade edge, for example, snow plow edge and method for replacing.

Rough terrain and cold weather conditions have caused problems for snow plow blades for as long as there have been snow plows. Although many modifications and alternative designs have been made to snow plow blades in attempts to improve the life, durability, and performance of snow plow blades, in particular, the life, durability and performance of snow plow blade edges, most of these modifications and alterations did not provide sufficient durability and ride improving capabilities to deal with, among other things, the rough terrain and cold weather that snow plow blades are typically exposed to. Typically, prior art snow plow edges are metallic, for example, steel, and are excessively damaged or even destroyed due to wear from contact between the plow edge and the terrain and corrosion (which is exacerbated by road salt). Such prior art blade edges must frequently be repaired or replaced.

Additionally, it is conventional to provide to the plow or plow attachment frame caster-like wheels, mushroom shoes, or wear skid shoes which are attached to, but spaced from, the plow moldboard for the purpose of supporting part of the load on the blade. These known prior art devices are relatively bulky, expensive to manufacture, and difficult to install on the snow plow. The cast iron material typically used on the wear shoes does not provide protection against fracturing or breakage, due to the relative brittleness of cast iron, when the shoes are subjected to impacts. The shoes are expensive to maintain and replace.

Thus, there has been a need for an improved means which supports the cutting edge of, for example, a snow plow blade from the roadbed for reducing the undesirable abrasive action on the blade edge. The disadvantages of present wear shoe constructions have resulted in the improved skid shoe-wear surface and mountings of the present disclosure which effectively reduces blade wear and shoe replacement resulting from road abrasion. Furthermore, the present disclosure can increase blade (cutting edge) life, moldboard shoe life, reduce blade breakage and maintenance, while protecting the moldboard body mounted thereto.

In one embodiment, the present disclosure relates to a combination carbide insert blade with steel impact bar system and moldboard shoes all combined into one unit. The moldboard shoes can include a wear surface including an abrasion resistant carbide matrix welding deposit filling one or more cavities along, and integrated with, the wear surface.

The present disclosure describes a device and mounting method which can be used to provide new plow blade edges or replace worn plow blade edges, in particular, snow-plow blade edges or other surface plows, that overcome many of the limitations of the prior art.

SUMMARY

One aspect of this disclosure provides a plow blade edge system for mounting to a moldboard of a plow comprising a first plow blade edge segment including at least one adapter blade including a bottom edge having a carbide insert along at least a portion of said bottom edge. The system further includes at least one moldboard shoe selectively reversible to present the adapter blade at a first angle or a second angle and at least one impact bar mounted to a front side of the adapter blade. The at least one moldboard shoe includes a bottom edge having a carbide insert along at least a portion of the bottom edge. A second plow blade edge segment adjacent to the first blade edge segment wherein the at least one impact bar is interlocked with at least another impact bar.

Another aspect of the disclosure provides for a plow blade edge segment for mounting to a moldboard of a plow comprising at least one plow blade edge segment integrally including at least one adapter blade including a bottom edge having a carbide insert along at least a portion of the bottom edge; at least one moldboard shoe selectively reversible to present the adapter blade at a first angle or a second angle; and, at least one impact bar mounted to a front side of the adapter blade. The at least one moldboard shoe includes a bottom edge having a carbide insert along at least a portion of the bottom edge. The at least one plow blade edge segment further includes at least on another plow blade edge segment mounted to the moldboard wherein adjacent impact bars are interlocked having a joint spanning across a merge line between the at least one adapter blade and at least another adapter blade.

Yet another aspect provides an expendable plow blade wear device adapted for replaceable attachment to a plow moldboard, comprising: the plow blade wear device integrally includes at least one adapter blade including a bottom edge having a carbide insert along at least a portion of the bottom edge; at least two moldboard shoes selectively reversible to present at least one adapter blade canted at a first angle or a second angle; and, at least one impact bar mounted to a front side of said adapter blade. The at least two moldboard shoes each include a bottom edge having a carbide insert along at least a portion of the bottom edge.

BRIEF DESCRIPTION OF THE DRAWINGS

The subject matter which is regarded as the disclosure is particularly pointed out and distinctly claimed in the concluding portion of the specification. The present disclosure, however, both as to organization and method of practice, together with further objects and advantages thereof, may best be understood by reference to the following detailed descriptions of the preferred embodiments and the accompanying drawings in which:

DETAILED DESCRIPTION

Figure 1:
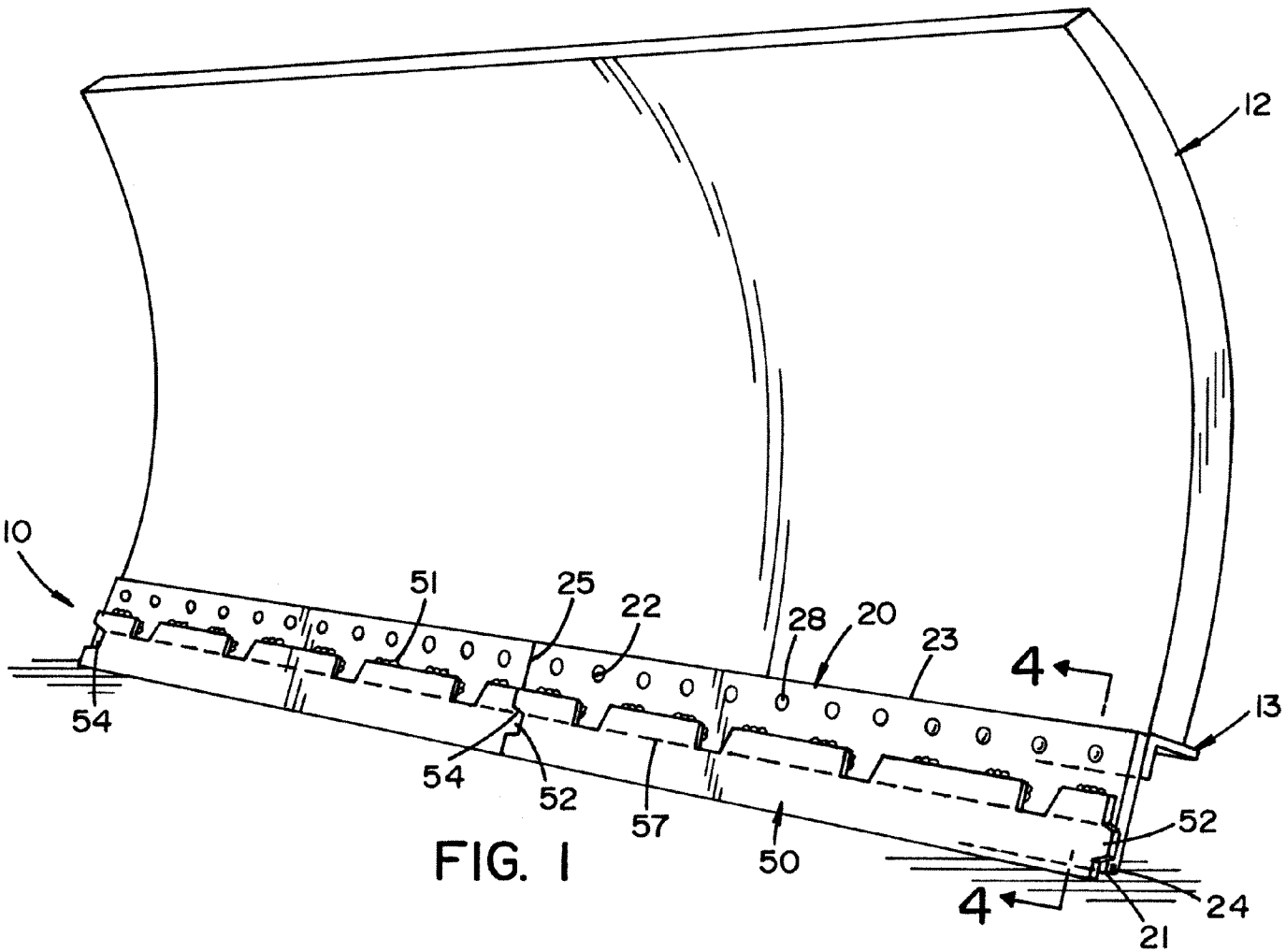
FIG. 1 is a front perspective view of a plow blade and plow blade edge system according to one aspect of the present disclosure.

FIG. 1 is a perspective view of the plow assembly which can include a plow body 12 which can be hemispherical and funnel shaped steel construction, or other materials, for deflecting snow or other media. Plow assembly is typically attached to a vehicle (not shown) by means of an appropriate frame or housing (also not shown). The vehicle may be any vehicle ranging from a standard car or pickup truck to a sand and salt carrying dump truck to a road grader having a belly mounted blade to huge earth moving or snow moving plows. The means of attaching plow body 12 to a vehicle may also typically include some form of hydraulic mechanism for positioning plow assembly as desired, as is typical in the art. The plow assembly may also include one or more reinforcing members (not shown) to provide strength and rigidity to plow body 12. Reinforcing members are typically standard structural angles which are attached to the back of plow body 12, for example, by means of welding.

In a first embodiment, a plow blade edge system 10 having wear resistant surfaces, edge blades, impact bars, and moldboard shoes, made in accordance with the teachings of the present disclosure is illustrated in FIGS. 1-11. Moldboard or skid shoes 14 can be used to reduce the extensive vibration, in fact, an abrasive action between the cutting edge of a snow plow blade and the associated skid shoes 14 along the road bed over which the snow plow travels. In one mounting arrangement, a pair of moldboard shoes 14 can be mounted on opposing ends of a plow blade or portions of a blade, as illustrated in FIGS. 3 and 7-9. The skid shoes 14, according to a first embodiment, include a mounting face 16 which can be secured to the backside of an adapter blade 20. The moldboard shoes 14 can be mounted close to the cutting edge 21 of the snow plow blade system 10. One of the advantages of the moldboard shoes 14 is that they can be welded to the adapter blade 20 such that the adapter blade 20, moldboard shoes 14, and impact protection bars 50 can be combined all in a single plow blade edge system unit 10. It is to be appreciated that the present construction and assembly eliminates complicated and bulky supporting structures, additional mounting elements and thereby reduces the time and costs of fitting the plow blade edge system 10 onto the snow plow blade 12.

It is to be appreciated that the mounting openings 22 for the plow blade edge system 10 are located proximal to a top edge 23 of adapter blade 20 at a standard spacing of 8 inch or 12 inch centers. As shown, the adapter blade 20 can be mounted to a plow body base member or moldboard 13 at the bottom of snow plow blade having 12 inch bolt hole centers or other spaced mounting arrangements.

The moldboard shoes 14 include generally lateral skid or wear surfaces 18. At least one cavity 15 can be cast into the moldboard shoes 14 at the time of casting. The moldboard shoes 14 can be cast from steel for greater strength and resiliency. A carbide matrix wear pad or weldments 17 can be welded into the cavity 15 to provide improved impact performance, wear resistance, and longer life to the plow blade edge system 10.

In one mounting arrangement (FIGS. 7 and 8), the skid shoes 14 are pre-mounted proximal to opposing ends of the adapter blade 20 (i.e. 4 foot length adapter blade). In another mounting arrangement (FIG. 9), a single skid shoe 14 can reside proximal to the center of an adapter blade 20 (i.e. 3 foot length adapter blade). The wear surfaces of skid shoes 14 reside close to, and in general alignment with, the blade cutting edge 21 and are thus a more integral part of the blade system 10 and therefore, capable of absorbing more of the undesirable abrasive wear and vibration.

The steel casting of the moldboard shoes 14 can take on the following analysis (balance iron).

| C ×100 | Mn ×100 | P ×1000 | S ×1000 | Si ×100 | Cr ×100 | B ×100 | Hardness Bhn 363/401 |
|---|---|---|---|---|---|---|---|
| 16 | 140 | 16 | 16 | 525 | 26 | 0.4 | |

The greater the impact resistance, shear strength, and hardness of the panel sections, generally the better. Accordingly, armor steel castings can be used, typically ones with high chromium, carbon and silicon contents. Other armor steels, quenched and tempered ultraservice steels, and maraging steels also are useful here. As stated above, the casting process can include the provision of one or more cavities 15 in association with the wear surfaces of the moldboard shoes 14.

Figure 4:
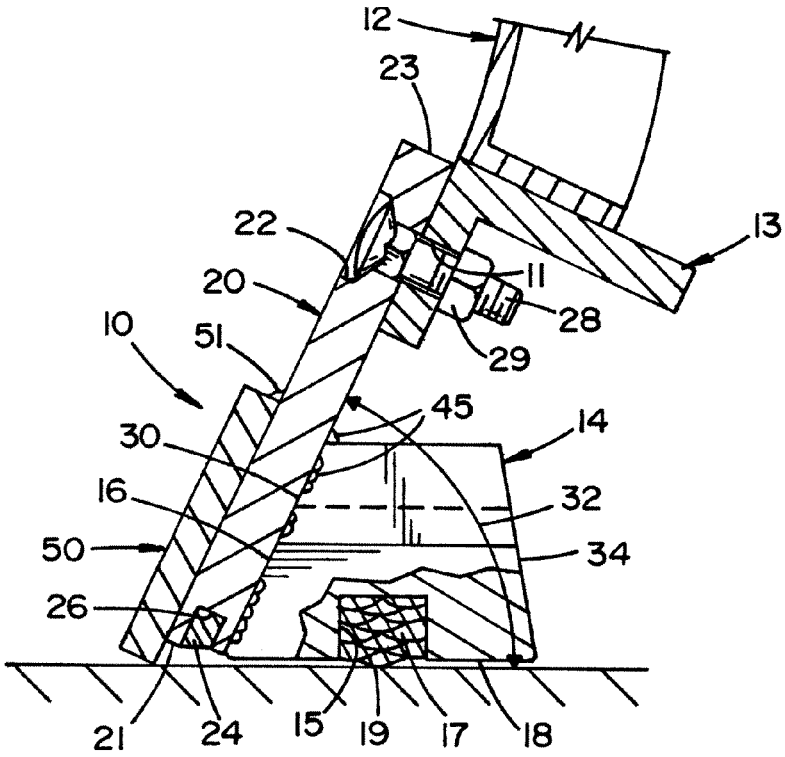
FIG. 4 is a cross sectional view taken along section lines 4-4 in FIG. 1 according to a first mounting arrangement of the plow blade edge system.
Figure 5:
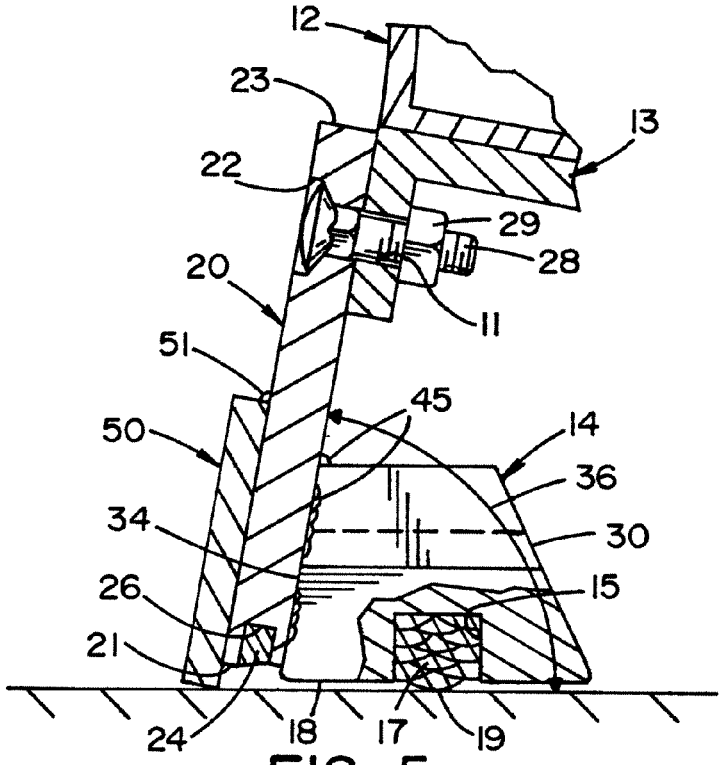
FIG. 5 is a cross sectional view of the plow blade edge system according to a second mounting arrangement.
Figure 6:
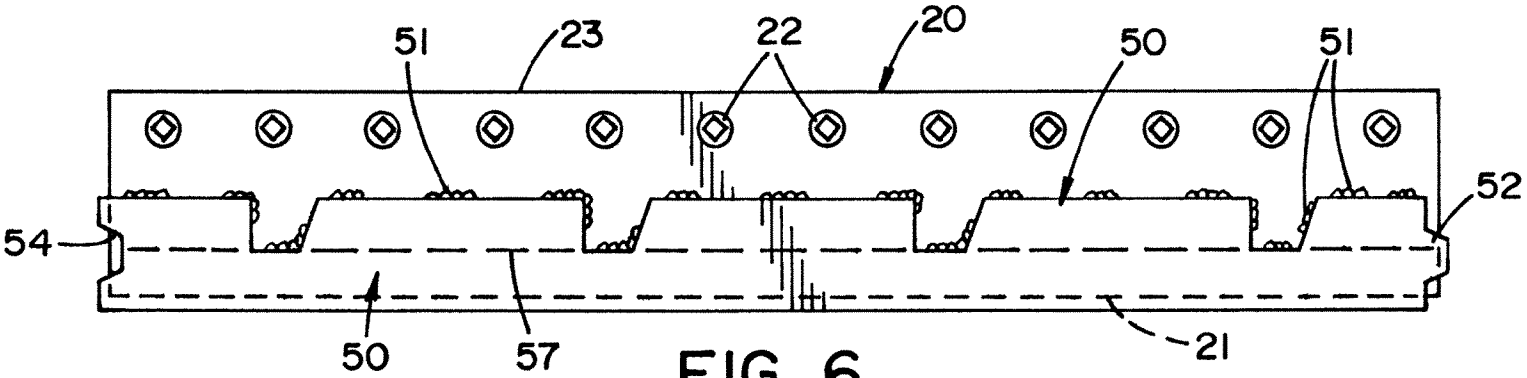
FIG. 6 is a front plan view of the plow blade edge system.
Figure 7:
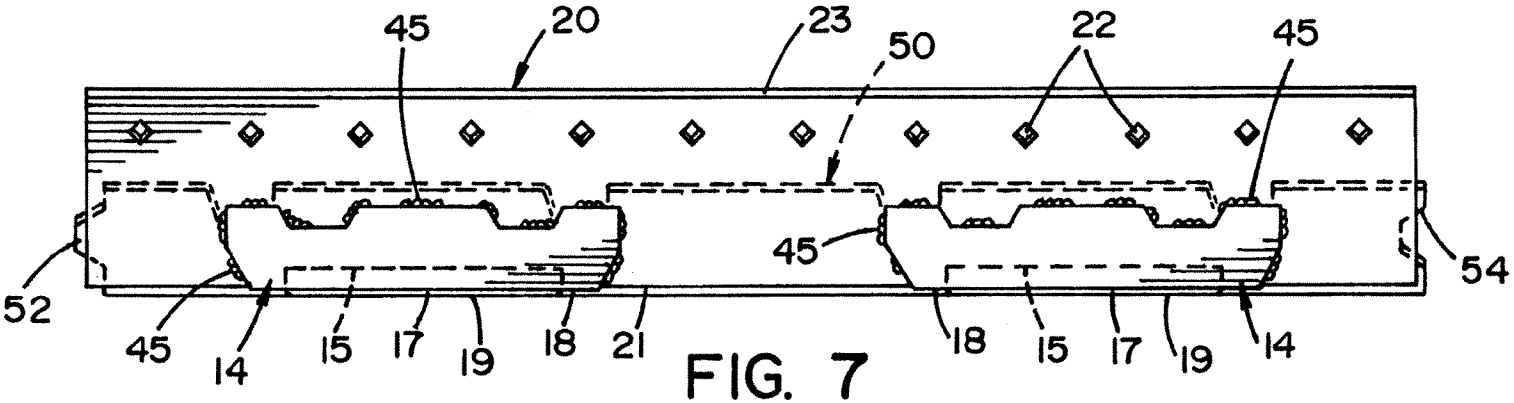
FIG. 7 is a rear plan view of the plow blade edge system.
Figure 8:
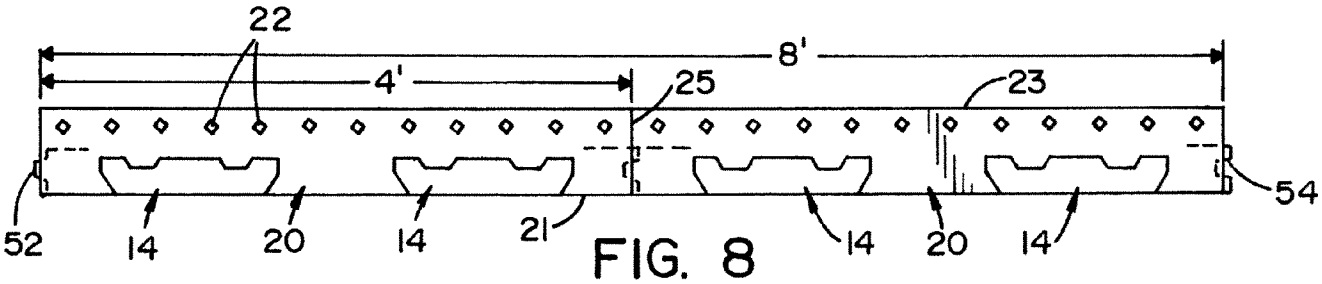
FIG. 8 is one exemplary mounting arrangement for a plurality of plow blade edges for an eight foot plow blade.
Figure 9:
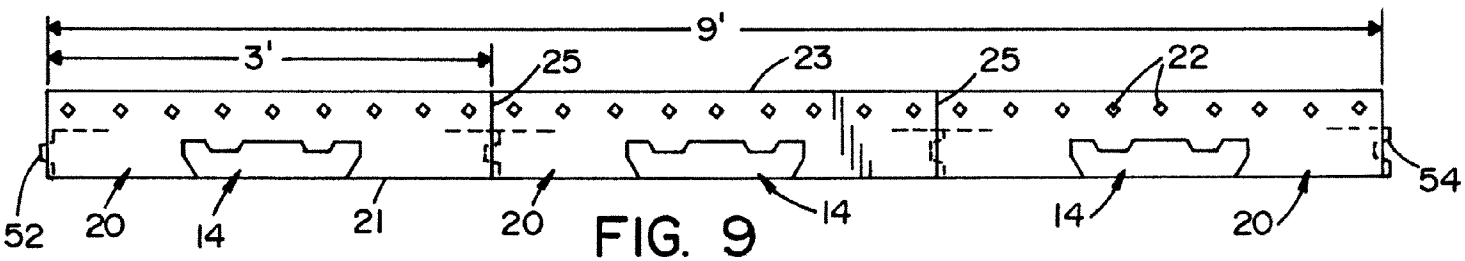
FIG. 9 is another exemplary mounting arrangement for a plurality of plow blade edges for a nine foot plow blade.
Figure 10:
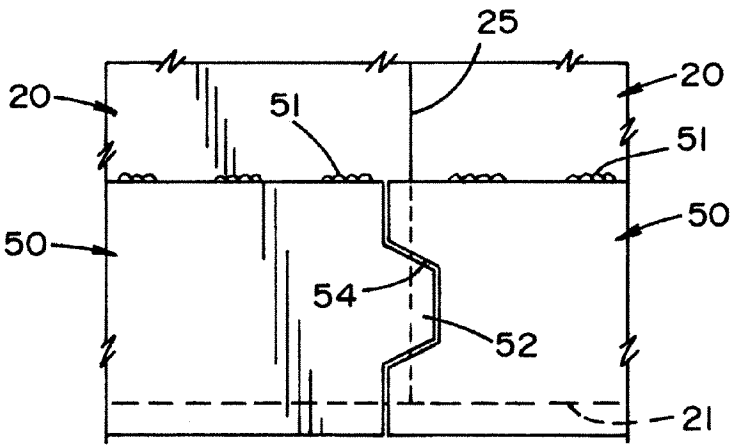
FIG. 10 is an enlarged partial view of two interlocked adjacent impact protection bars; and, FIG. 11 is a cross sectional view of a plow blade and plow blade edge system according to another embodiment of the present disclosure and according to still a third mounting arrangement.
Figure 11:
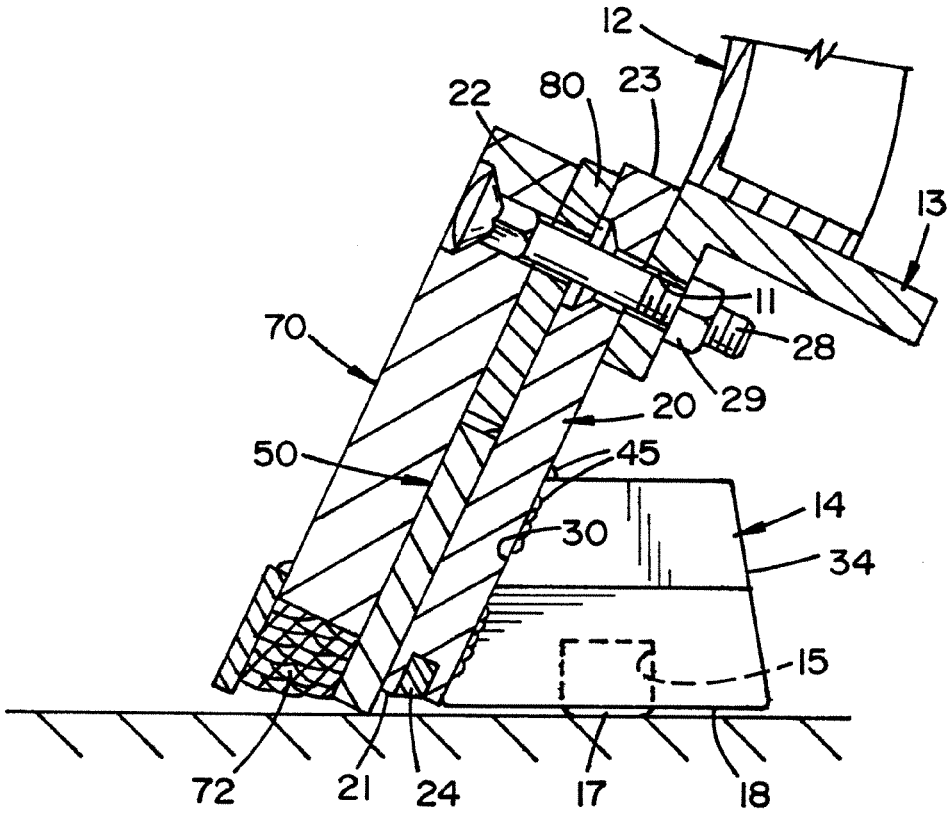

Subsequent to casting, the cavities 15 can be filled and/or overfilled by welding therein layered carbide matrix 17. The layered carbide matrix 17 can be composed of a series of layered deposits one on top of another until the cavity 15 is filled or overfilled. Overfilling the cavity 15 can result in a convex or bulbous layer 19 of carbide matrix terminating beyond, i.e. extending below, the wear surface 18 of the shoe 14. The matrix 17 provides a reconstitutable embedded weldment or resistor for increased wear resistance of the wear surface 18. In one exemplary embodiment, one longitudinal cavity 15 extends along substantially the length of the wear surface 18. As shown in FIGS. 4 and 5 the welding deposit 17 (in an unworn state) in the cavity 15 can overfill the cavity forming substantially bulbous deposit 19 extending outwardly from the wear or bottom surface 18 of the moldboard shoe 14.

The weldments 17 can comprise a weight of between 0.5 and 2 pounds. The weldments 17 can increase the weight of each shoe from about 2% to about 10%. The weldments 17 can be aligned with the wear surface 18 such that when the plow is in use and traveling along the road surface, the weldments 17 are transverse to the direction of travel. Alternatively, the weldments 17 can be aligned with or canted to, the direction of travel (not shown). The surface area of the weldments 17 can comprise from about 15% to about 45% of the total surface area of the bottom wear surface 18. The moldboard shoes 14 are cast steel and have a generally one inch wide carbide matrix wear pad imbedded approximately ¾ inch into the bottom of each shoe. The moldboard shoes can be provided separate from the adapter blade 20 and impact bar 50 such that the user can tack weld the moldboard shoe 14 in the mounting arrangement as desired.

The weld deposits can have the following analysis (balance iron):

| C | Cr | Mo | Si | Mn | Hardness/Rc 55-60 |
|---|---|---|---|---|---|
| X100 2.60 | X100 12.00 | X100 0.62 | X100 1.37 | X100 .77 | |

Conventional hard-facing or wear-facing weldments 17 can be used for the deposits. So-called chrome carbide steels are the most common, e.g., STOODY COMPANY NO. 121, although vanadium carbide (STOODY NO. 134) and tungsten carbide ones also can be used very effectively. It is to be appreciated that the weldment material 17 deposited in the cavity 15 has a higher hardness than the steel casting.

The weldment metal 17 must be abrasion-resistant. Generally, it is a high chrome ferrous metal weld. It is reconstitutable in the sense that it can be repaired or replaced by redeposition of carbide matrix by welding.

In addition, the adapter blade 20 can include a channel 26 in association with its wear surface. Channel 26 can include a weldment 24 similar in composition to weldment 17. Weld deposit 24 in channel 26 can be transverse to the direction of travel. The wear surface 21 and the embedded or integrated weldments 24 help to support the cutting edges of the adapter blade 20 and impact bar 50 such that the abrasive action and impact from the roadbed works on the wear surface 18 and weldments 17 of the skid or moldboard shoes 14 instead of the blade cutting edges 21, thereby substantially prolonging the life of the cutting edge 21 of adapter blade 20 and impact bar 50. In addition, the weldments 17 substantially prolong the life of the associated shoe 14 due to the wear surface 18 being a combination of carbide matrix and steel casting. The present moldboard shoes 14 are intended to perform better than mechanically fastened solid carbide bars would under the extreme conditions of vibration, impact and thermal shock experienced by snow plow blades.

The moldboard shoes 14 are adapted to be welded 45 (i.e. tack welded) to the back side of the adapter blade 20. In one mounting arrangement (FIG. 8), wherein a four foot section of adapter blade 20 is used, two moldboard shoes 14 are welded to opposing ends. In another mounting arrangement (FIG. 9), wherein a three foot section of adapter blade 20 is used, a single moldboard shoe 14 can be welded to a generally central position on the adapter blade 20.

As shown in FIG. 4, one mounting arrangement for the moldboard shoe 14 includes a first mounting face 30 welded to the adapter blade 20 wherein the adapter blade 20 is at an angle 32 from about 55° to about 75° relative to the ground surface. This mounting arrangement can be applied to a front or main plow section (FIG. 1). As shown in FIG. 5, a second mounting arrangement includes a second mounting face 34 welded to the adapter blade 20 wherein the adapter blade 20 is at an angle 36 from about 70° to about 90° relative to the ground surface. The second mounting arrangement can be used for a side or wing plow mounting configuration (not shown). Referring again to FIGS. 1 and 4, the first mounting arrangement provides an "angle of attack" of the front or main plow blade 12 for effective plowing of a road surface. Referring to FIG. 5, it is to be appreciated that the second mounting arrangement provides an "angle of attack" which optimizes the plowing of snow or other material for a wing or side plow blade (not illustrated). The moldboard shoe 14 thus, provides two mounting arrangements and supports the two most preferred plow blade arrangements.

The plow blade edge system 10 can include the moldboard shoes 14, adapter bar or blade 20, and impact protection bars 50 as discussed above. The adapter blade 20 can be mounted to plow body base member or moldboard 13. Moldboard 13 typically includes slotted perforations 11 to allow for adjustments in the mounting of the plow blade edge system 10 during initial installation or replacement after use and wear. Referring again to FIGS. 4-5, the plow blade edge system 10 is therein displayed wherein the adapter blade 20 can be mounted (i.e. bolt 28 and nut 29) to moldboard 13. The adapter blade includes mounting holes aligned along a top edge for securing to moldboard 13 of plow body 12. The adapter blade 20 can be from about ¼ inch thick to about 1¼ inch thick and can be made from steel or similar materials. As described above, the bottom edge 21 along the adapter blade 20 can include high grade embedded carbide inserts 24 along at least a portion thereof. The carbide inserts 24 provide a resistant wear surface along the bottom edge 21 of the adapter blade 20. It is to be appreciated that the carbide inserts 24 in conjunction with the carbide matrix 17 imbedded in the moldboard shoes 14 work in unison to resist wear of the plow blade edge system 10.

The number of plow blade edge segments 10 mounted to a plow body will vary depending upon the size of plow body 12 used. For example, the length of the adapter blade 20 is limitless, but adapter blades 20 typically will have sections of 3 or 4 foot lengths. In this manner, any combination of two, or three, blade segments 10 can be combined to extend across a plow blade having a length of 6, 7, 8, 9, 10, 11, or 12 feet.

On the outward facing surface of the adapter blade 20, the impact protection bar 50 can be welded 51 (i.e. tack welded) thereto. The impact bar 50 can include male 52 and female 54 interlocking portions configured to interlock with another adjacent impact bar 50. The interlocking mechanism stabilizes the entire plow blade edge system 10. It is to be appreciated that the impact bar 50 adds additional protection to the system 10 and helps absorb impact which extends the wear life of both the adapter blade 20 and the moldboard shoes 14.

Figure 2:
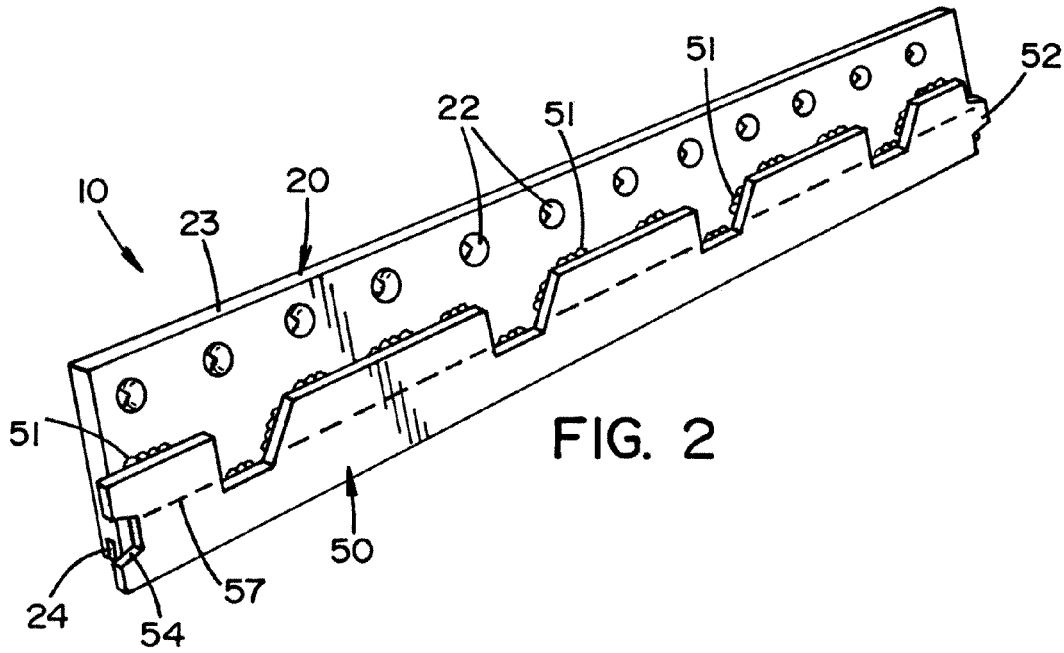
FIG. 2 is a front perspective view of a plow blade according to one aspect of the present disclosure.
Figure 3:
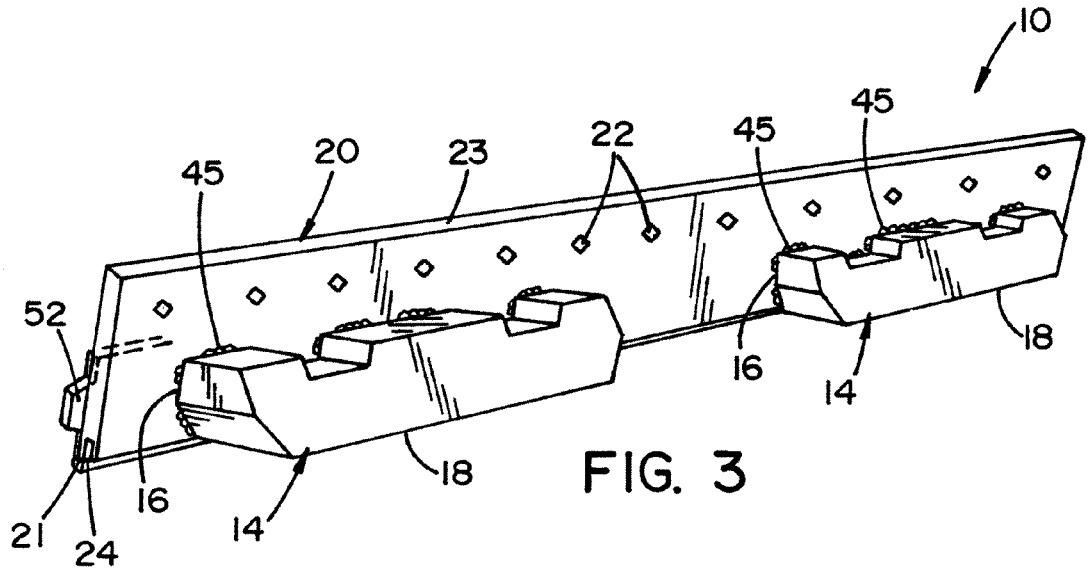
FIG. 3 is a rear perspective view of a plow blade edge system according to one aspect of the present disclosure.

Referring now to FIG. 2, there is shown a wear termination or replacement line 57 on impact bar 50. The wear replacement line 57 indicates when the plow blade edge system 10 should be replaced. The wear line 57 can be reached, for example, when all, or substantially all, of the carbide matrices 17, 24 have worn off, or abraded away, which can correspond to approximately 50% of wear of the steel impact protection bar 50. The dimensions of the impact bar 50 will vary depending upon the size of plow body 12 used, for example, the length of the impact bar 50 is limitless, but the impact bar 50 typically can have section lengths of 3 or 4 feet. The width or height of the impact bar 50 can be from about 2.0 to about 5.0 inches. The thickness of the impact bar 50 can be from about 0.250 inches to about 1.250 inches. As described above, any number of combinations of these exemplary lengths can be used to accommodate varying size of the plow blade body from 6 feet to 12 feet, et al. The end 52 of one bar 50 is designed to interlock an adjacent end 54 of another bar 50 thereby stabling the plow blade edge system 10. Thus, the male interlock section 52 of one impact bar 50 can be interlocked with a female section 54 of another adjacent interlock bar 50. The male 52 and female 54 interlock sections overlap a joint 25 of adjacent adapter blades thereby stabilizing the adapter blade 20 sections. In conjunction therewith, one or more integral plow blade edge sections 10 can be independently mounted or replaced. In this manner, one person can single-handedly replace one (or more) integral plow blade edge sections 10 as needed in one simple section swap.

In another embodiment, the plow blade edge device 10 can further include a plow guard or curb guard 70 (FIG. 11) attached to adapter blade 20 and positioned along a front side of impact bar 50. The guards 70 provide even further protection and wear resistance to moldboard 13 and plow body 12. The guards 70 can also include a carbide matrix 72 along a bottom edge for increased blade end protection. A pre-drilled mounting plate or shim 80 can be positioned above impact bar 50 and secured between guard 70 and adapter blade 20. The shim 80 fills the gap between guard 70 and adapter blade 20 and provides a more secure mounting structure.

While the present disclosure has been particularly shown and described with reference to preferred embodiments, it will be understood by those skilled in the art that various changes in form and details may be made to the present disclosure without departing from the spirit and scope of the present disclosure described in the following claims.

The invention claimed is:

1. A plow blade edge system for mounting to a moldboard of a plow comprising:

a first plow blade edge segment and a second plow blade segment; each plow blade segment including:

at least one adapter blade including a bottom edge having a carbide insert along at least a portion of said bottom edge;

at least one moldboard shoe selectively reversible to present said adapter blade at a first angle or a second angle wherein said at least one moldboard shoe includes a bottom edge having a carbide insert along at least a portion of said bottom edge, at least one impact bar mounted to a front side of said adapter blade;

wherein said first plow blade edge segment is mounted adjacent said second plow blade edge segment wherein said at least one impact bar of said first plow blade segment is interlocked with said at least one impact bar of said second plow blade segment when attached to said moldboard.

2. The plow edge system as recited in claim 1, wherein each said at least one moldboard shoe is cast steel.

3. The plow edge system as recited in claim 1, wherein said plow edge system is mounted to a front plow moldboard including each said at least one moldboard shoe in said first angle.

4. The plow edge system as recited in claim 3, wherein said plow edge system is mounted to a wing plow moldboard including each said at least moldboard shoe in said second angle.

5. The plow edge system as recited in claim 1, wherein each said at least one moldboard shoe is welded to a back side of each said adapter blade.

6. The plow edge system as recited in claim 5, wherein each said at least one impact bar is welded to said front side of said at least one adapter blade.

7. The plow edge as recited in claim 5, further including at least two moldboard shoes welded to the back side of each said at least one adapter blade.

8. The plow edge as recited in claim 7, wherein each said impact bars include a wear line demarcating when the plow blade edge system needs replacing.

9. The plow edge as recited in claim 1, wherein interlocked said impact bars include an interlocking joint spanning across a merge line between said at least one adapter blade of the first plow blade segment and said at least one adapter blade of said second plow blade segment.

10. The plow edge as recited in claim 9, wherein said first angle is from about 55 degrees to about 75 degrees relative to the ground surface therebelow.

11. The plow edge as recited in claim 10, wherein said second angle is from about 70 degrees to about 90 degrees relative to the ground surface therebelow.

12. A plow blade edge system for mounting to a moldboard of a plow comprising:

a first plow blade edge segment and a second plow blade segment; each plow blade segment including:

at least one adapter blade including a bottom edge having a carbide insert along at least a portion of said bottom edge;

at least one moldboard shoe selectively reversible to present said adapter blade at a first angle or a second angle wherein said at least one moldboard shoe includes a bottom edge having a carbide insert along at least a portion of said bottom edge, at least one impact bar mounted to a front side of said adapter blade;

wherein said first plow blade edge segment is mounted adjacent said second plow blade edge segment wherein said at least one impact bar of said first plow blade segment is interlocked with said at least one impact bar of said second plow blade segment when attached to said moldboard wherein interlocked said impact bars include an interlocking joint spanning across a merge line between said at least one adapter blade of the first plow blade segment and said at least one adapter blade of said second plow blade segment.

13. The plow edge system as recited in claim 1, wherein each said at least one moldboard shoe is cast steel.

14. The plow edge system as recited in claim 1, wherein said plow edge system is mounted to a front plow moldboard including each said at least one moldboard shoe in said first angle.

15. The plow edge system as recited in claim 3, wherein said plow edge system is mounted to a wing plow moldboard including each said at least moldboard shoe in said second angle.

16. The plow edge system as recited in claim 1, wherein each said at least one moldboard shoe is welded to a back side of each said adapter blade.

17. The plow edge system as recited in claim 5, wherein each said at least one impact bar is welded to said front side of said at least one adapter blade.

18. The plow edge as recited in claim 5, further including at least two moldboard shoes welded to the back side of each said at least one adapter blade.

19. The plow edge as recited in claim 7, wherein each said impact bars include a wear line demarcating when the plow blade edge system needs replacing.

20. The plow edge as recited in claim 9, wherein said first angle is from about 55 degrees to about 75 degrees relative to the ground surface therebelow.

21. The plow edge as recited in claim 10, wherein said second angle is from about 70 degrees to about 90 degrees relative to the ground surface therebelow.

22. An expendable plow blade wear system adapted for replaceable attachment to a plow moldboard, comprising:

at least one plow blade wear device, each at least one plow blade wear device integrally includes:

at least one adapter blade including a bottom edge having a carbide insert along at least a portion of said bottom edge;

at least two moldboard shoes selectively reversibly mounted to said at least one adapter blade to cant to the ground surface below at a first angle or a second angle relative to said at least one adapter blade;

at least one impact bar mounted to a front side of said adapter blade; and, said at least two moldboard shoes each including a bottom edge having a carbide insert along at least a portion of said bottom edge.

23. The plow blade wear device as recited in claim 22, wherein said at least two moldboard shoes are cast steel.

24. The plow blade wear device as recited in claim 22, wherein said first angle is from about 55 degrees to about 75 degrees relative to the ground surface therebelow.

25. The plow blade wear device as recited in claim 24, wherein said second angle is from about 70 degrees to about 90 degrees relative to the ground surface therebelow.

26. The plow blade wear device as recited in claim 22, further including a second plow blade wear device having a second at least one impact bar mounted to a front side of a second at least another adapter blade wherein said first and second plow blade devices are adjacent and said first and second at least one impact bars include an interlocking joint overlapping a merge line between said first at least one adapter blade and second at least one adapter blade.

27. The plow blade wear device as recited in claim 22, further including a plow guard positioned on a front side of said at least one impact bar and mounted to said at least one adapter blade.

* * * * *